US010030848B2

(12) United States Patent
Cao et al.

(10) Patent No.: US 10,030,848 B2
(45) Date of Patent: Jul. 24, 2018

(54) PARABOLIC LED LAMP

(71) Applicant: Ningbo Yamao Optoelectronics Co., Ltd., Zhejiang (CN)

(72) Inventors: Maojun Cao, Zhejiang (CN); Hui Chen, Zhejiang (CN); Hu Fang, Zhejiang (CN)

(73) Assignee: NINGBO YAMAO OPTOELECTRONICS CO., LTD., Zhenjiang (CN)

( * ) Notice: Subject to any disclaimer, the term of this patent is extended or adjusted under 35 U.S.C. 154(b) by 220 days.

(21) Appl. No.: 15/028,911

(22) PCT Filed: Apr. 7, 2016

(86) PCT No.: PCT/CN2016/078673
§ 371 (c)(1),
(2) Date: Apr. 12, 2016

(87) PCT Pub. No.: WO2017/166328
PCT Pub. Date: Oct. 5, 2017

(65) Prior Publication Data

US 2018/0087744 A1 Mar. 29, 2018

(30) Foreign Application Priority Data

Mar. 31, 2016 (CN) ..... 2016 1 0203483
Mar. 31, 2016 (CN) ..... 2016 2 0270723 U

(51) Int. Cl.
*F21V 19/02* (2006.01)
*F21V 7/06* (2006.01)
(Continued)

(52) U.S. Cl.
CPC ..... *F21V 7/06* (2013.01); *F21K 9/232* (2016.08); *F21K 9/235* (2016.08); *F21K 9/238* (2016.08);
(Continued)

(58) Field of Classification Search
CPC . F21V 7/06; F21V 5/004; F21V 5/002; F21V 5/007; F21V 14/04; F21V 13/06;
(Continued)

(56) References Cited

U.S. PATENT DOCUMENTS 9,752,749 B2 * 9/2017 Adams ..... F21V 5/04
2011/0194282 A1 * 8/2011 Paik ..... F21V 5/007 362/245

(Continued)

*Primary Examiner* — Anh Mai
*Assistant Examiner* — Matthew Peerce
(74) *Attorney, Agent, or Firm* — Andrew F. Young, Esq.; Lackenbach Siegel, LLP

(57) ABSTRACT

The invention discloses a parabolic LED lamp, comprises a lamp body, a lamp base, an arc lens, a parabolic reflective cup, an LED light source, and a drive; wherein the parabolic reflective cup is embedded and installed in the lamp body; the LED light source is installed in the bottom of the parabolic reflective cup and toward to the arc lens; the drive internally configured in the lamp body connects the lamp base and the LED light source; the inner wall of the arc lens is formed with a plurality of first lens areas and second lens areas spaced apart, the first lens areas uniformly distributed with a plurality of small hexagonal lenses with a same specifications, the second lens areas uniformly distributed with a plurality of small rhombic lenses with a same specifications.

9 Claims, 4 Drawing Sheets

(51) Int. Cl.

| | |
|---|---|
| ***F21K 9/238*** | (2016.01) |
| ***F21V 5/04*** | (2006.01) |
| ***F21V 17/10*** | (2006.01) |
| ***F21V 14/04*** | (2006.01) |
| ***F21K 9/232*** | (2016.01) |
| ***F21K 9/235*** | (2016.01) |
| ***F21V 13/06*** | (2006.01) |
| *F21Y 115/10* | (2016.01) |

(52) U.S. Cl.
CPC ..... *F21V 5/04* (2013.01); *F21V 13/06* (2013.01); *F21V 14/04* (2013.01); *F21V 17/10* (2013.01); *F21V 17/101* (2013.01); *F21Y 2115/10* (2016.08)

(58) Field of Classification Search
CPC .. F21V 5/04; F21K 9/233; F21L 9/238; F21L 9/232; F21L 9/235
See application file for complete search history.

(56) References Cited

U.S. PATENT DOCUMENTS

2014/0268796 A1* 9/2014 Yoder ..... F21V 29/505 362/294
2014/0347852 A1* 11/2014 Feit ..... F21K 9/23 362/235

* cited by examiner

PARABOLIC LED LAMP

CROSS REFERENCE TO RELATED APPLICATIONS

This application relates to and claims priority as a § 371 national phase filing from Ser. PCT/CN2016/078673 filed Apr. 7, 2016, the entire contents of which are incorporated herein by reference, which in turn claims priority directly from CN 201620270723.8 filed Mar. 31, 2016 and CN 201610203483.4 filed Mar. 31, 2016.

FIGURE SELECTED FOR PUBLICATION

FIG. 1

BACKGROUND OF THE INVENTION

Field of the Invention

The invention relates to the field of LED lighting technology, more particularly, to a parabolic LED lamp.

Description of the Related Art

As green lighting, LED (light emitting diode) lamp has been paid more and more attention due to its high brightness, energy-saving and environmental protection, good performance of shock and vibration resistance, long life, high efficiency of light and other apparent advantages. The light emitting and light distributing features of LED light source accord with the radiation characteristics of Lambertian light emitter in the case of not being reflected by an anti-halo or refracted by a lens, such emitters are also known as the cosine emitters. The illumination intensity of the light emitted from LED light source is very nonuniform and we can't control the light emitted from LED light source without light distribution.

In order to obtain more uniform lighting effects, generally using one or more reflection by reflective lampshade to distribute light emitted from the LED light source to ensure uniform illumination. However, the reflective type LED lamps after a reflection, the light emitted from which is not fully projected onto the reflective lampshade, some of the light emits directly outside the lamps without being reflected, which is not conducive to adjust the angle of the emergent ray and the distribution of the light intensity of LED lamps. The structure of lamps of which the light emitted from the LED light source emitting after multiple reflections is more complex in structure, and the production cost is higher, which additionally increases the production cost of the LED lamps and does not conducive to promote the use of LED lamps.

In addition, the formation of the beam angle of existing LED parabolic aluminum reflector (PAR) lamps uses COB (the cost of COB (Chip On Board) light source is higher than SMD (Surface Mounted Devices) light source) as a light source to achieve the predetermined beam angle of the product by a lens made from a multi-refraction reflective cup or PMMA, to ensure the distribution of light intensity in effective irradiated areas. The disadvantages thereof are the defects such as black and yellow spots, the light emitting area is small through the COB light source and the light exiting area is small through the limitation of angle by a reflective panel, which cause a small irradiated area in equidistance position, and phenomenon of nonuniform distribution of light after multiple refractions by the reflective cup. And, PMMA is easy to deteriorate to decrease the light transmittance, so that the light of lamps fades large. The light intensity and brightness is higher in the light focused center, central light intensity free falls into effective dark space when greater than 10°. At the same time during the product assembling, the center point of the COB light source and the reflective cup must be the same; if not, the beam angle of which appears a phenomenon of not a parabola.

ASPECTS AND SUMMARY OF THE INVENTION

Aimed at the above-mentioned problems existing in the prior art, this invention seeks to provide a parabolic LED lamp with simple structure and uniform light intensity.

The specific technical solution is as follow:

a parabolic LED lamp having such characteristics, comprising: a revolving-body-shaped lamp body, a lamp base covered and installed on one end of the lamp body, an arc lens installed on another end of the lamp body, an LED light source configured toward the arc lens, and a drive internally configured in the lamp body and connected to the lamp base and the LED light source; and further comprising a parabolic reflective cup embedded and installed in the lamp body and an opening of the parabolic reflective cup directly facing the arc lens; and the LED light source is installed in a bottom of the parabolic reflective cup; wherein the inner wall of the arc lens formed with a plurality of first lens areas and second lens areas spaced apart, the first lens areas uniformly distributed with a plurality of small hexagonal lenses with a same specifications, the second lens areas uniformly distributed with a plurality of small rhombic lenses with a same specifications.

In the above-mentioned parabolic LED lamp, wherein the first lens areas and the second lens areas all extend spirally radially outward from a center of the arc lens.

In the above-mentioned parabolic LED lamp, wherein the arc lens and the end of the lamp body are cemented by adhesive.

In the above-mentioned parabolic LED lamp, wherein, the arc lens is clamped with the end of the lamp body.

In the above-mentioned parabolic LED lamp, wherein the arc lens is embedded with the end of the lamp body.

In the above-mentioned parabolic LED lamp, wherein the arc lens and the end of the lamp body are occluded in the form of mechanical curling.

In the above-mentioned parabolic LED lamp, wherein a rim of the parabolic reflective cup and the arc lens are cemented by adhesives.

In the above-mentioned parabolic LED lamp, wherein the rim of the parabolic reflective cup and the arc lens are connected upside down.

In the above-mentioned parabolic LED lamp, wherein in a rectilinear direction from the lamp base to the arc lens, a diameter of the lamp body gradually increases.

In the above-mentioned parabolic LED lamp, wherein the center of the lamp body has an arc portion projected outward.

In the above-mentioned parabolic LED lamp, wherein the parabolic reflective cup is spinning and stamping moulded by aluminum.

In the above-mentioned parabolic LED lamp, wherein the LED light source and the bottom of the parabolic reflective cup are detachably connected by a plurality of threaded fasteners; and the plurality of threaded fasteners are distribute as an annular array around the axis of the lamp body.

The positive effects of the above-mentioned technical solution are:

In the parabolic LED lamp of above-mentioned structure, parts of the beams emitted from the LED light source directly emit to the arc lens; and, another parts of the beams emitted from the LED light source gather and reflect by the arc sidewall of the parabolic reflective cup to form a certain beam angle to the arc lens, the small hexagonal lenses and the small rhombic lenses of the arc lens then uniformly extend and refract the received directly emitted beams and reflected beams outward, under the combination effect of the optical reflection of the parabolic reflective cup and the optical refraction of the arc lens; the angle of the emergent ray of the parabolic LED lamp can be adjust to a desired state, and the light intensity of the parabolic LED lamp can be more soft and uniform. In addition, the light fall within an effective angle of the light emitted from the parabolic LED lamp has no ladder phenomenon.

Further, the parabolic LED lamp with above-mentioned structure is only configured with a single parabolic reflective cup, and light beams emitted from the LED light source pass only one reflection, which does not make the structure of LED lights complicated, and effectively controls the manufacturing cost of LED lights.

The above and other aspects, features and advantages of the present invention will become apparent from the following description read in conjunction with the accompanying drawings, in which like reference numerals designate the same elements.

Figure 1:
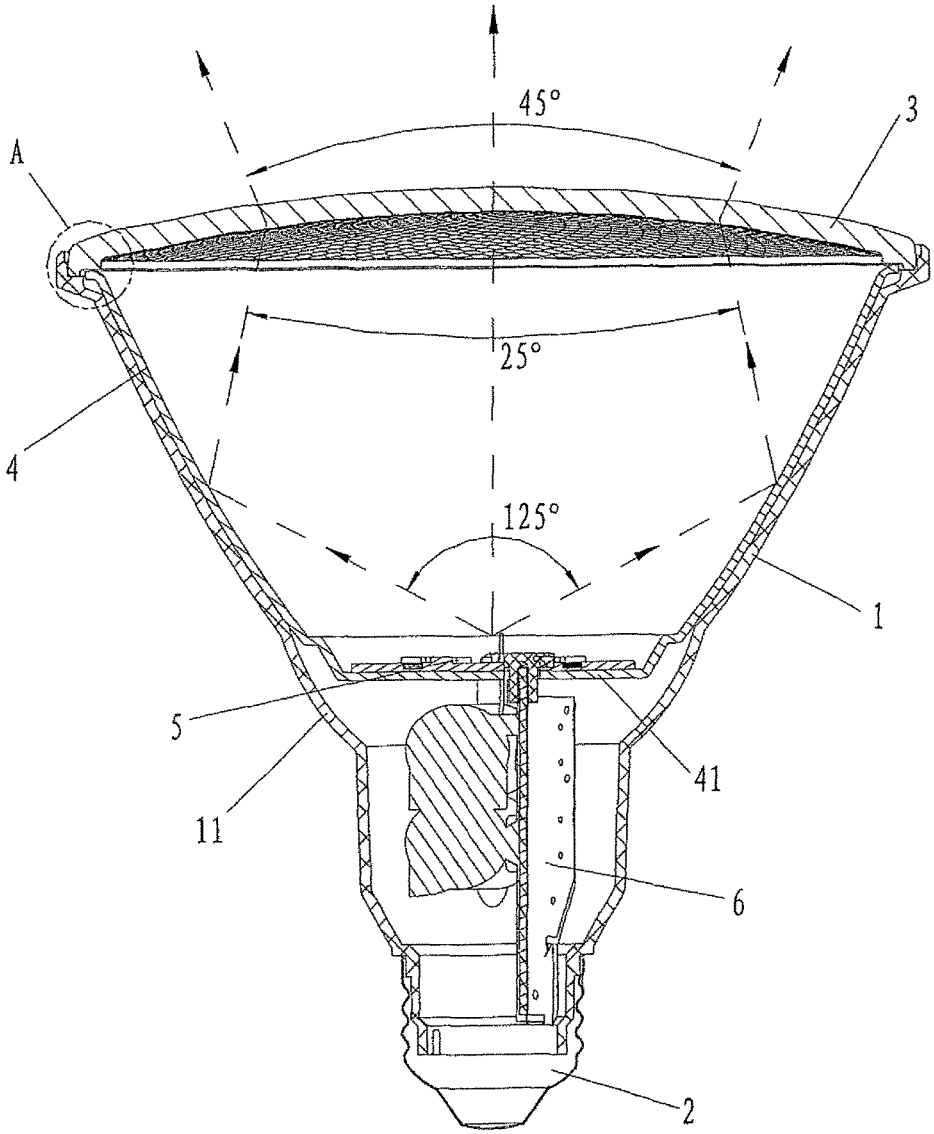
FIG. 1 is a semi-sectional view of an embodiment of a parabolic LED lamp of the invention.

In the drawings: 1, lamp body; 11, arc portion; 2, lamp base; 3, arc lens; 31, small hexagonal lens; 32, small rhombic lens; 4, parabolic reflective cup; 41, bottom of the cup; 42, rim of the cup; 5, LED light source; 6, drive; 7, threaded fasteners.

DETAILED DESCRIPTION OF THE PREFERRED EMBODIMENTS

Reference will now be made in detail to embodiments of the invention. Wherever possible, same or similar reference numerals are used in the drawings and the description to refer to the same or like parts or steps. The drawings are in simplified form and are not to precise scale. The word 'couple' and similar terms do not necessarily denote direct and immediate connections, but also include connections through intermediate elements or devices. For purposes of convenience and clarity only, directional (up/down, etc.) or motional (forward/back, etc.) terms may be used with respect to the drawings. These and similar directional terms should not be construed to limit the scope in any manner. It will also be understood that other embodiments may be utilized without departing from the scope of the present invention, and that the detailed description is not to be taken in a limiting sense, and that elements may be differently positioned, or otherwise noted as in the appended claims without requirements of the written description being required thereto.

Various operations may be described as multiple discrete operations in turn, in a manner that may be helpful in understanding embodiments of the present invention; however, the order of description should not be construed to imply that these operations are order dependent.

In order to make the technical means, the technical features, the purpose and the effects achieved of the invention easy to understand, the following embodiments with reference to the accompanying drawings 1-4 elaborate the technical solution provided in the invention, however the following content is not a limitation of the invention.

Figure 2:
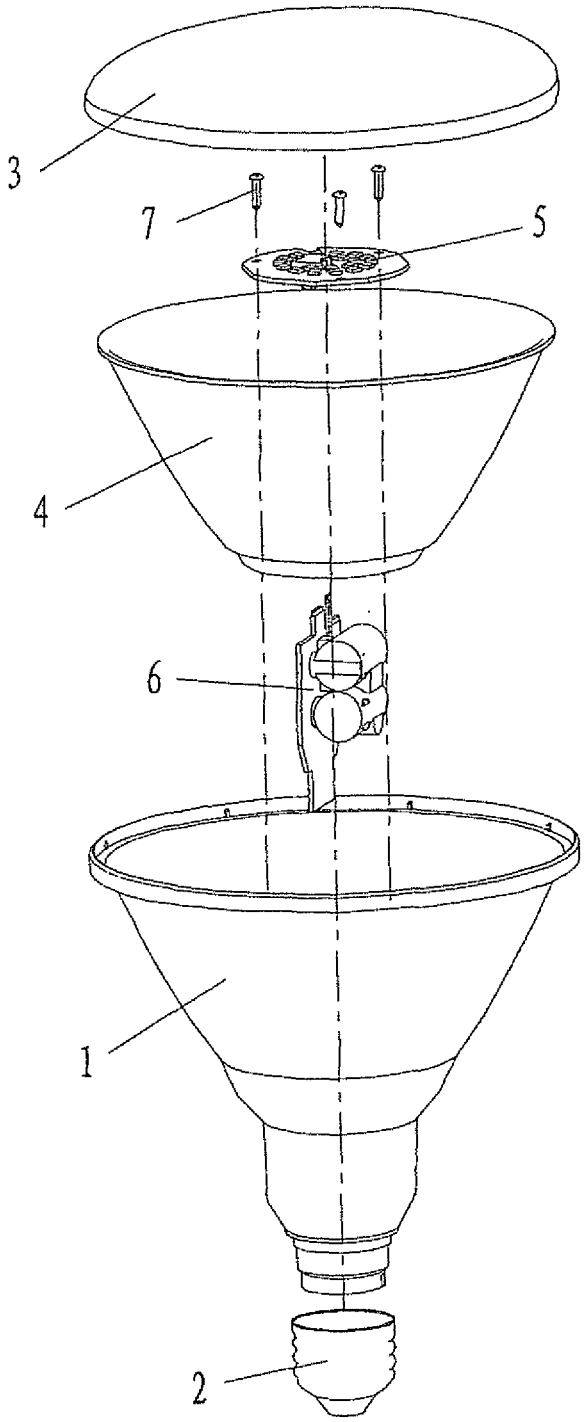
FIG. 2 is an explosive view of an embodiment of a parabolic LED lamp of the invention.

FIG. 1 is a semi-sectional view of an embodiment of a parabolic LED lamp; FIG. 2 is an explosive view of an embodiment of a parabolic LED lamp. As shown in FIG. 1 and FIG. 2, the parabolic LED lamp provided in the embodiment comprises: lamp body 1, lamp base 2, arc lens 3, parabolic reflective cup 4, LED light source 5, and drive 6.

Specifically, the lamp body 1 shows a revolving-body-shape, and is injection-moulded by heat sink materials. One end of the lamp body 1 is covered and installed with a lamp base 2, which can be one of screw type or bayonet type. The other end of the lamp body 1 is installed with an arc lens 3, which is hot injection-moulded by glasses. A parabolic reflective cup 4 is embedded and installed in the lamp body 1, and the opening of which directly faces the arc lens 3. The LED light source 5 is installed in the bottom 41 of the parabolic reflective cup 4 and toward the arc lens 3. A drive 6 is connected to the lamp base 2 and the LED light source 5 is internally configured in the lamp body 1.

Figure 4:
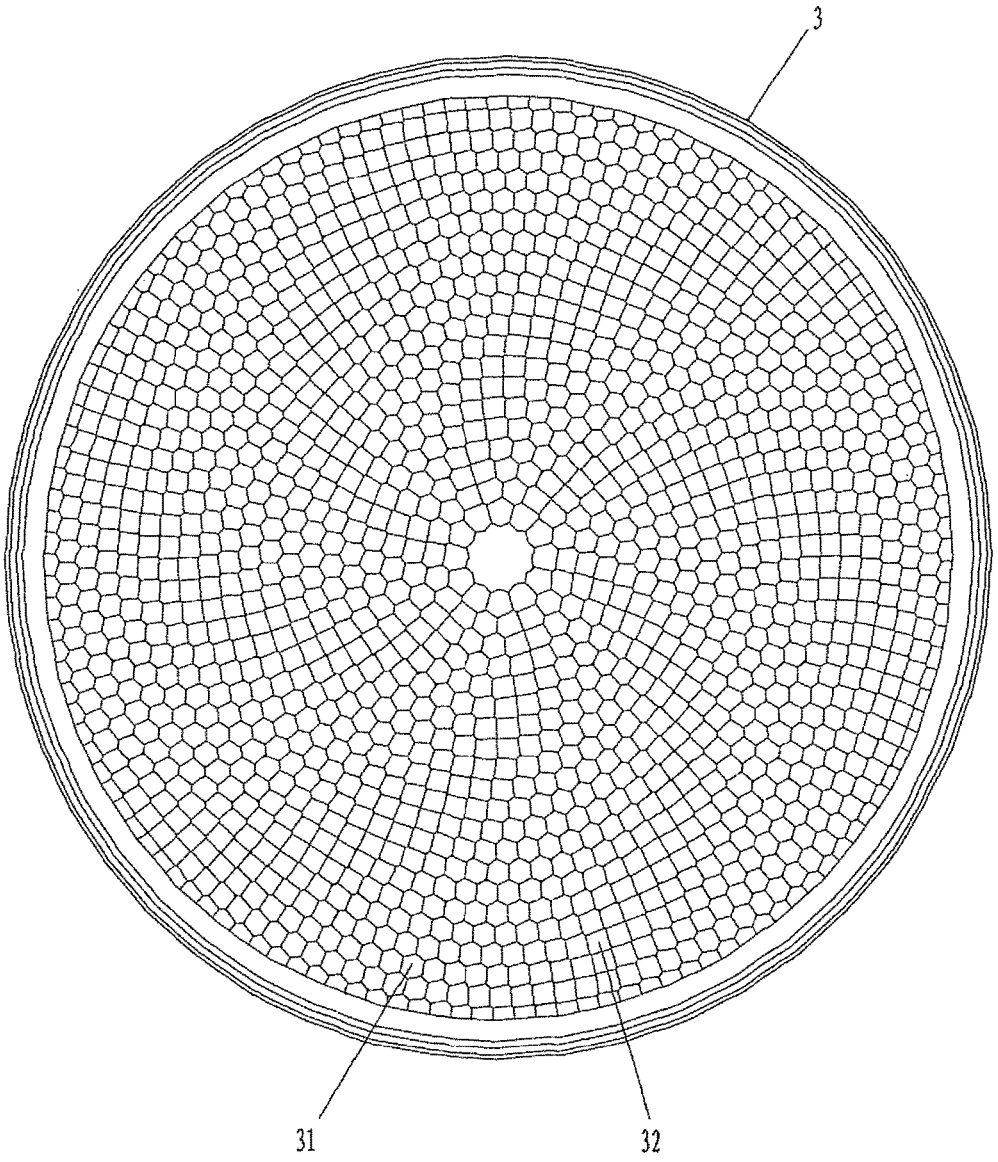
FIG. 4 is a structure diagram of an embodiment of the arc lens of a parabolic LED lamp of the invention.

FIG. 4 is a structure diagram of an embodiment of the arc lens of a parabolic LED lamp of the invention. As shown in FIG. 1 and FIG. 4, the inner wall of the arc lens 3 is formed with a plurality of first lens areas and second lens areas spaced apart; the first lens areas uniformly are distributed with a plurality of small hexagonal lenses 31 with a same specifications, the second lens areas are uniformly distributed with a plurality of small rhombic lenses 32 with a same specifications. In addition, as a preferred embodiment, the first lens areas and the second lens areas all extend spirally radially outward from a center of the arc lens 3.

It should be noted that, in this embodiment, since the seamed edges of the small hexagonal lenses 31 and the small rhombic lenses 32 are all transition-connected by an arc; therefore, when observing the arc lens from outside, the shape of the small hexagonal lenses 31 and the small rhombic lenses 32 are approximately circular. In addition, the size and density of the small hexagonal lenses 31 and the small rhombic lenses 32 all can be properly adjusted according to dimming needs. Of course, as a modified embodiment, the inner wall of the arc lens 3 can also be densely distributed with a plurality of small circular lenses.

Figure 3:
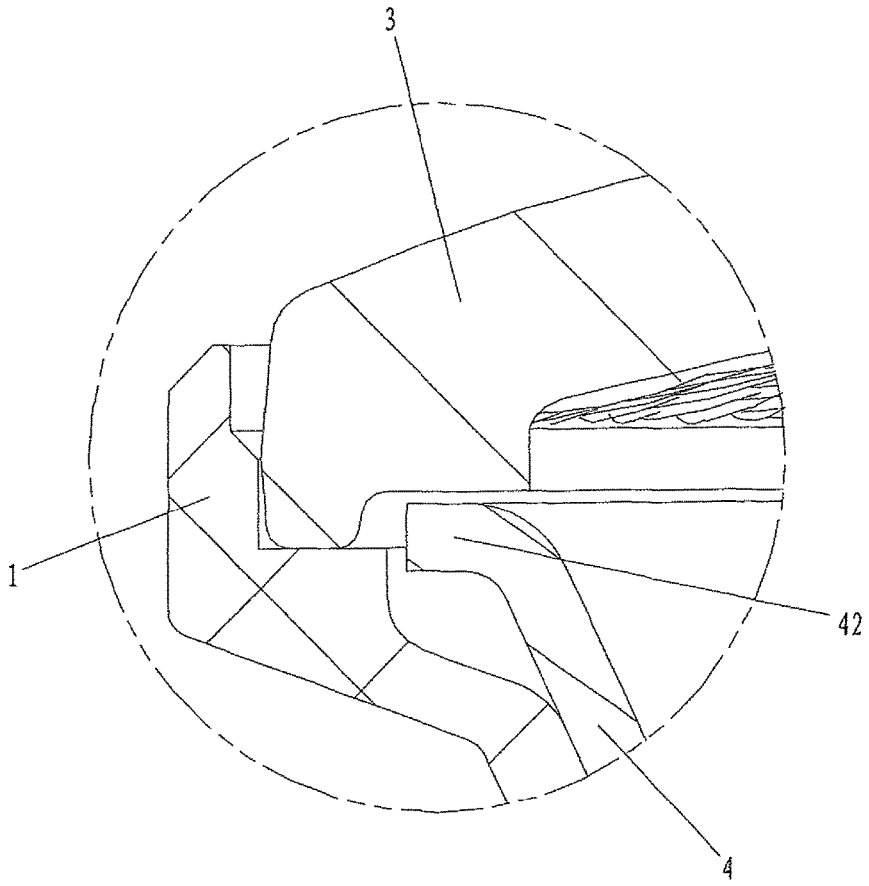
FIG. 3 is an enlarged view of the corresponding part of letter A in FIG. 1.

FIG. 3 is art enlarged view of the corresponding part of letter A in FIG. 1. As shown in FIG. 1 and FIG. 3, further, in this embodiment, as a preferred embodiment, the arc lens 3 and the end of the lamp body 1 are cemented by adhesive. Namely, the arc lens 3 and the end of the lamp body 1 are connected in a fixed way.

Of course, the arc lens 3 and the end of the lamp body 1 can also be connected in a detachable way; as another preferred embodiment, the arc lens 3 is clamped with the end of the lamp body 1 in the form of combining snaps and necks.

As another preferred embodiment, the arc lens 3 is embedded with the end of the lamp body 1.

As another preferred embodiment, the arc lens 3 and the end of the lamp body 1 are occluded in the form of mechanical curling.

Further, in order to prevent the distance changing between the LED light source 5 and the arc lens 3 caused by shaking of the parabolic reflective cup 4; as a preferred embodiment, the rim 42 of the parabolic reflective cup 4 and the arc lens 3 are cemented by adhesive. Of course, the rim 42 of the parabolic reflective cup 4 and the arc lens 3 can also be connected in a detachable way, for example, the rim of the parabolic reflective cup and the arc lens are connected upside down.

Further, in order to make the parabolic LED lamp have a good beam angle, as a preferred embodiment, in the rectilinear direction from the lamp base 2 to the arc lens 3, the diameter of the lamp body 1 gradually increases. In addition, the center (i.e. near the bottom 41 portion of the parabolic reflective cup 4) of the lamp body 1 has an arc portion 11 projected outward.

Further, in order to be able to carry out rapid cooling to LED light source 5, and considering the manufacturing cost and weight of the parabolic reflective cup 4, as a preferred embodiment, the parabolic reflective cup 4 is spinning and stamping moulded by aluminum.

As shown in FIG. 2, further, as a preferred embodiment, the LED light source 5 and the bottom 41 of the parabolic reflective cup 4 are detachably connected by a plurality of threaded fasteners 7; wherein the threaded fasteners 7 can be screws or bolts. And, more preferably, the threaded fasteners 7 are distributed as an annular array around the axis of the lamp body 1.

As shown in FIG. 1, the dotted lines and arrows indicate the direction of light propagation. In this embodiment, the angle of the light beam emitted from the LED light source 5 is 125°, wherein parts of the beams emitted from the LED light source 5 directly emit to the arc lens 3; and, the other parts of the beams emitted from the LED light source 5 are gathered into 25° angle by the arc sidewall of the parabolic reflective cup 4 and reflect to the arc lens 3, the small hexagonal lenses 31 and the small rhombic lenses 32 of the arc lens 3 then uniformly extend and refract the received direct beams and reflected beams outward in a 45° angle, thus under the combination effect of the optical reflection of the parabolic reflective cup 4 and the optical refraction of the arc lens 3, the angle of the emergent ray of the parabolic LED lamp can be adjust to the best state, and the light intensity of the parabolic LED lamp can be more soft and uniform.

In this embodiment, the emitting angle of the above-mentioned LED light source 5, the gathering angle of light beams of the parabolic reflective cup 4, the refracting angle of light beams of the arc lens 3 are preferred values. Of course, in the parabolic LED lamp provided in the invention, the emitting angle of the LED light source, the gathering angle of light beams of the parabolic reflective cup and the refracting angle of light beams of the arc lens can be adjusted accordingly according to the design purpose.

The foregoing is only the preferred embodiments of the invention, not thus limiting embodiments and scope of the invention, those skilled in the art should be able to realize that the schemes obtained from equivalent substitution and obvious changes using the content of specification and figures of the invention are within the scope of the invention.

Having described at least one of the preferred embodiments of the present invention with reference to the accompanying drawings, it will be apparent to those skills that the invention is not limited to those precise embodiments, and that various modifications and variations can be made in the presently disclosed system without departing from the scope or spirit of the invention. Thus, it is intended that the present disclosure cover modifications and variations of this disclosure provided they come within the scope of the appended claims and their equivalents.

What is claimed is:

1. A parabolic LED lamp, comprising:

a lamp body, having a shape of rotational symmetry around a central axis;

a lamp base, covered and installed on one end of the lamp body;

an arc lens, installed on another end of the lamp body;

an LED light source, configured toward the arc lens; and a drive, internally configured in the lamp body and connected to the lamp base and the LED light source;

wherein the parabolic LED lamp further comprises: a parabolic reflective cup, embedded and installed in the lamp body, and an opening of the parabolic reflective cup directly facing the arc lens; and the LED light source is installed in a bottom of the parabolic reflective cup;

wherein an inner wall of the arc lens is formed with a plurality of first lens areas and second lens areas spaced apart; the first lens areas uniformly distributed with a plurality of small hexagonal lenses with a same specification, the second lens areas uniformly distributed with a plurality of small rhombic lenses with a same specification; and wherein the first lens areas and the second lens areas all extend spirally radially outward from a center of the arc lens.

2. The parabolic LED lamp according to claim 1, wherein the arc lens and the end of the lamp body are cemented by adhesive.

3. The parabolic LED lamp according to claim 1, wherein the arc lens is clamped with the end of the lamp body.

4. The parabolic LED lamp according to claim 1, wherein the arc lens is embedded with the end of the lamp body.

5. The parabolic LED lamp according to claim 1, 2, 3 or 4, wherein a rim of the parabolic reflective cup and the arc lens are cemented by adhesive.

6. The parabolic LED lamp according to claim 1, wherein, in a rectilinear direction from the lamp base to the arc lens, a diameter of the lamp body gradually increases.

7. The parabolic LED lamp according to claim 6, wherein a center of the lamp body has a raised portion projected outward.

8. The parabolic LED lamp according to claim 1, wherein the parabolic reflective cup is spinning and stamping moulded by aluminum.

9. The parabolic LED lamp according to claim 1, wherein the LED light source and the bottom of the parabolic reflective cup are detachably connected by a plurality of threaded fasteners;

and the plurality of threaded fasteners are distributed as an annular array around the axis of the lamp body.

* * * * *